United States Patent [19]

Coenen

[11] 3,964,381

[45] June 22, 1976

[54] APPARATUS FOR TYING BUNDLES

[76] Inventor: Clayton J. Coenen, 2646 W. Spencer Road, Appleton, Wis. 54911

[22] Filed: Jan. 15, 1975

[21] Appl. No.: 541,191

[52] U.S. Cl. ..... 100/34; 53/390

[51] Int. Cl.[2] ..... B65B 13/04; B65B 67/00

[58] Field of Search ..... 53/135, 390; 93/93 R; 100/34

[56] References Cited

UNITED STATES PATENTS

| | | | |
|---|---|---|---|
| 1,882,343 | 10/1932 | Troth | 53/135 X |
| 3,145,646 | 8/1964 | Levy | 100/34 |
| 3,382,794 | 5/1968 | Lindholm et al. | 100/34 |
| 3,491,681 | 1/1970 | Saro et al. | 100/34 |
| 3,498,214 | 3/1970 | Bailey | 100/34 |

FOREIGN PATENTS OR APPLICATIONS

| | | | |
|---|---|---|---|
| 1,205 | 5/1909 | United Kingdom | 100/34 |

*Primary Examiner*—Robert L. Spruill
*Attorney, Agent, or Firm*—Quarles & Brady

[57] ABSTRACT

A box upholstered to serve as a hassock has a hinged top and a false floor. Beneath the floor a spool of cord is mounted, and cord is strung through a hole in the floor and a diagonal channel in the front wall to the top wall and about a peg in the front corner, and diagonally down through a channel about a removable dowel at the edge of the floor, across the floor and about a second dowel and diagonally upward about a second peg. From the second peg the cord extends diagonally downward about a third dowel and across the floor to a fourth dowel along the front edge and upward to the first dowel where both ends of the cord are fastened together forming a closed loop. When newspapers fill the box, the corners of the loop of twine are lifted off the pegs, drawn toward each other and the dowels are removed. Then the corners of the twine are drawn tightly together and clipped, and the tied bundle lifted out of the box.

6 Claims, 7 Drawing Figures

Fig. 4
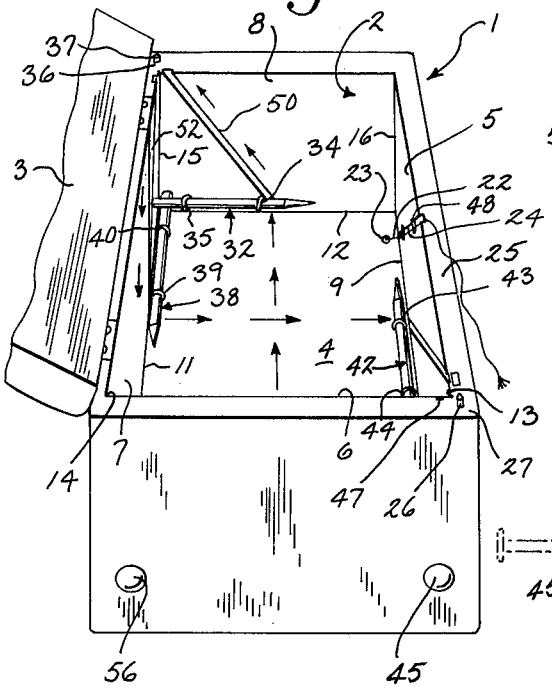
Fig. 5
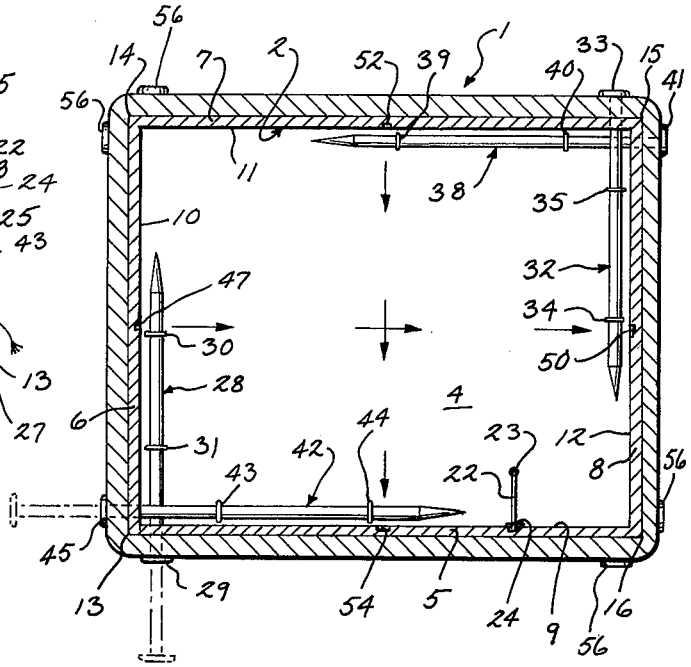
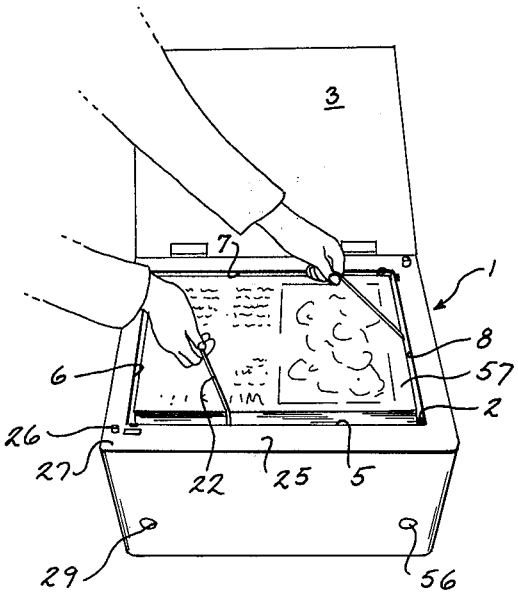
Fig. 6
Fig. 7
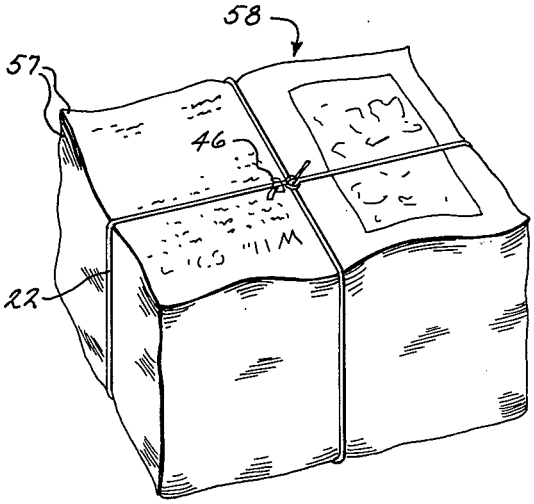

APPARATUS FOR TYING BUNDLES

BACKGROUND OF THE INVENTION

As the supply of raw materials for making paper diminishes relative to the rapidly increasing demand for paper products, the value of used paper for recycling into new paper products increases. This increased value of wastepaper not only provides individuals with an incentive to save discarded papers for resale, but on a much larger scale, has stimulated many municipalities to pass ordinances requiring citizens to package wastepaper separate from other trash for pick-up and sale by the municipalities. Thus a need developed for some convenient place in the home where wastepaper can be stored and packaged for convenient disposal. At the same time, the increase in apartment dwelling creates a demand for some means of storing wastepapers in a compact, attractive form until disposal.

Newspapers and the like are not only difficult and awkward to tie into neat bundles, but if allowed to accumulate in the open, they create unsightly piles that harbor insects and rodents and create a fire hazard. Thus in addition to a convenient means of storage that does not occupy space in crowded quarters, the storage means should be attractive to look at. Also, a bailer of some sort is needed to aid the average homeowner in binding the newspapers into tight, secure bundles of a size that will hold a substantial amount of paper, and yet be small enough to be easily carried by the homeowner. However, any bailing apparatus for home use must be simple, manually operated and inexpensive. A device that will bind bundles of paper, may also be usable for binding other types of bundles and packages. The present invention was designed to satisfy this growing demand.

SUMMARY OF THE INVENTION

The present invention relates to an appartus for binding bundles, and more particularly it resides in the combination of a hopper for receiving a bundle to be bound, which hopper has a floor with two pairs of opposite edges and has a pair of diagonally opposite corner structures that are located approximately adjacent diagonally opposite upper corners of the bundle to be bound, and releasable cord retainers mounted on each of the opposite edges of the floor and on each of the pair of diagonally opposite corner structures, which cord retainers will receive and hold a binding cord prestrung diagonally from said corners to said floor edges on opposite sides of said corners and transversely across said floor and will release the cord when the bundle is being securely bound so that said bundle may be removed from the hopper.

The foregoing combination provides a bailer for binding stacks of papers or any other package or bundle, without requiring tying of any knots. Such a bailer may have a solid floor with sides that can be decorated as a piece of furniture with a hinged top to appear as a table or stool in an apartment, or it may be a relatively simple, open structure sufficient to support the bundle to be tied for use in a utility area. The dimensions of the hopper may be fixed, or they may be adjustable to accommodate the bundle to be bound. These and other objects and advantages will become apparent in the description of the preferred embodiment below.

BRIEF DESCRIPTION OF THE DRAWINGS

In the drawings:

FIG. 4 is a top view in perspective from the end opposite from FIG. 3 illustrating the interior of the present invention;

FIG. 5 is a top plan view of the preferred embodiment in section taken along the line 5—5 in FIG. 1;

FIG. 6 is a view in perspective of the preferred embodiment of the present invention illustrating the manner in which a bundle of papers is tied; and FIG. 7 is a perspective view of a bundle of newspapers tied using the present invention.

DETAILED DESCRIPTION OF THE PREFERRED EMBODIMENT

Figure 1:
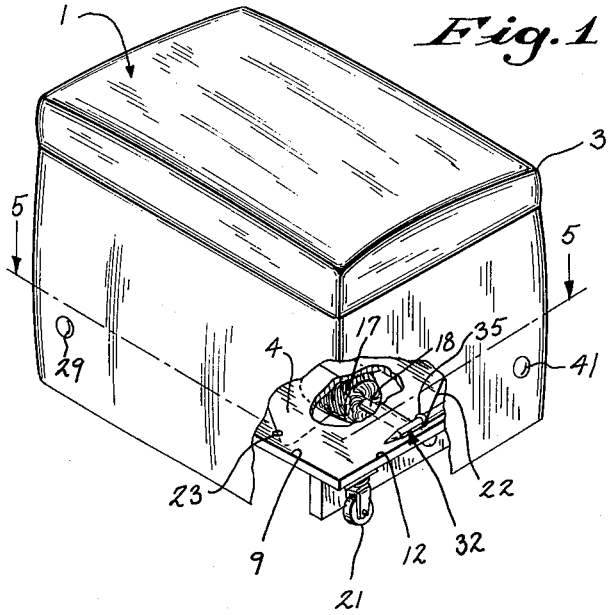
FIG. 1 is a perspective view of a preferred embodiment of the present invention with portions broken away to illustrate its interior mechanism.

The preferred embodiment of this invention as illustrated in the drawings, is enclosed and upholstered to serve also as a hassock 1 or ottoman 1 so that it can perform its storage and bailing functions while also serving an additional purpose in a living room so as not to occupy any additional space in a small home or apartment where space may be at a premium. For this purpose, this embodiment of the invention has a hopper 2 that is an enclosed, wooden box 2, with a cover 3 that is hinged to open upwardly, the sides and cover 3 of the hopper 2 being upholstered to fit the decor of the room. The hopper 2 has a floor 4 and four side walls 5, 6, 7 and 8, respectively, that are joined to the floor 4 at its edges 9, 10, 11 and 12 in a conventional manner. The side walls 5 through 8, respectively, are also joined together forming corners 13, 14, 15 and 16, and the side walls 5 through 8 extend below the floor 4 to conceal a space beneath the floor 4 for housing a spool 17 of binder cord 22 which is mounted on a shaft 18, the ends of which are journaled in holes 19 and 20, respectively, in the opposite end walls 6 and 8. To facilitate movement of the ottoman 1, it rests on four swivel casters 21, one of which is shown, so that it may be moved with ease even when filled.

Figure 3:
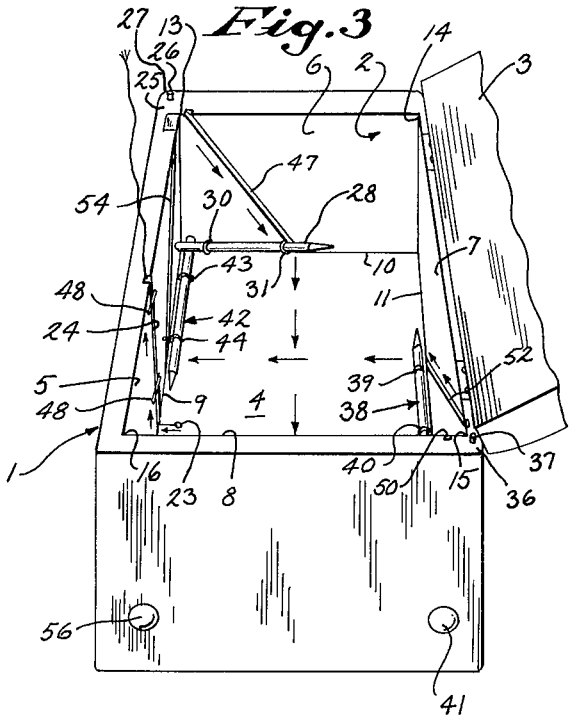
FIG. 3 is a top end perspective view of the preferred embodiment of the present invention with the top open to illustrate the interior.
Figure 2:
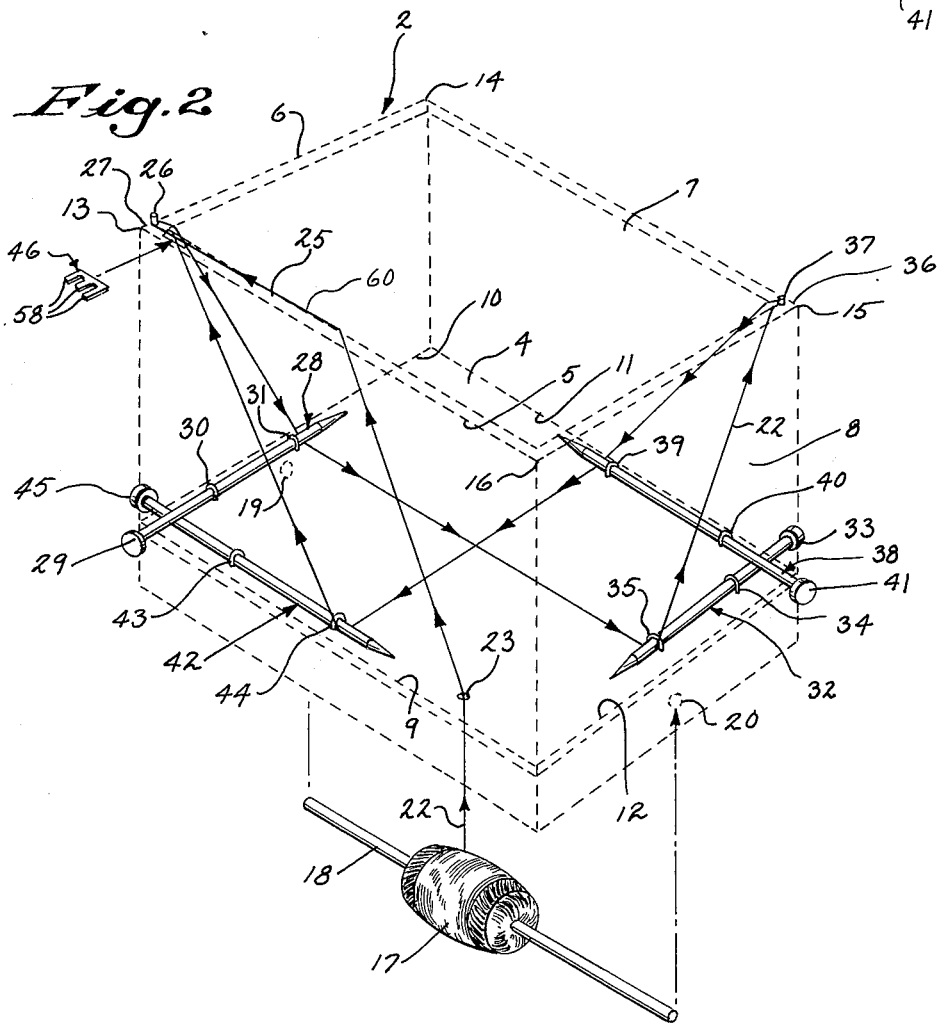
FIG. 2 is a diagrammatic representation in perspective illustrating the stringing of cord in the preferred embodiment of the invention.

The working apparatus of the present embodiment as a bailer, or apparatus for tying bundles, resides in the structure for stringing the binder cord 22 in the hopper 2 prior to placing the papers or other articles to be tied into the hopper 2, and this working apparatus is illustrated diagrammatically in FIG. 2. The spool 17 is shown in exploded position and from it cord 22 is drawn through a hole 23 in the floor 4 and a channel 24 that slants upward in the front side wall 5, as is illustrated in FIGS. 3 and 4. In FIG. 2, arrowheads represented on the twine 22 indicate the direction in which the cord 22 is strung, and after the cord 22 is pulled through the hole 23 and the channel 24, it is drawn along a top edge 25 of the side wall 5 to a peg 26 in the top corner structure 27 created by the junction of the front side wall 5 and the end side wall 6. The peg 26 serves as a releasable cord retainer for holding the cord until it is ready to be released to complete the tie of the bundle. The cord 22 passes around the outside of the peg 26 and diagonally down to the center of the end edge 14 of the floor 4 through a channel 47 in the end wall 6. A dowel 28 with a decorated circular head 29 passes through a hole (not shown) in the front wall 5 of the hopper 6 and beneath two eyes 30 and 31 formed by staples driven into the floor 4. The dowel 28 and the eye 31 form another releasable cord retainer.

From the dowel 28, the twine 22 is strung directly, transversely across the floor 4 of the hopper 2 to the center of the opposite edge 12 of the floor 4 and there it is strung about a second dowel 32, which likewise has a decorated head 33 and passes through the back wall 7 of the hopper 2 through a hole (not separately shown) and through two eyes 34 and 35 created by screw eyes 34 and 35 turned into the floor 4 of the hopper 2, to hold the dowel 28 against lateral movement but allow it to be slid axially. The dowel 32 and the eye 35 form a releasable retainer for the cord 22 which passes diagonally through a channel 50 in the end wall 8 from the dowel 32 up to a corner structure 36 formed by the top of the junction of the back wall 7 and the end wall 8. In the top of the corner structure 36 a peg 37 projects upwardly to form a releasable retainer for the cord, and about which the twine 22 passes. From the peg 37, the cord 22 is strung diagonally downward through a channel 52 in the back wall 7 to the center of the back edge 15 of the floor 4 where it passes beneath a third dowel 38, which, with an eye 39, forms a releasable cord retainer for the twine 22. The dowel 38, like the other dowels 28 and 32, slides through a hole (not separately shown) through the end wall 8 of the hopper and through two eyes 39 and 40. The end of the dowel 38 has a decorated head 41 on it so that it can be readily grasped and pulled outwardly or inserted inwardly.

From the dowel 38, the cord 22 passes transversely across the floor 4 of the hopper 2 and beneath a fourth dowel 42 which is mounted adjacent the front edge 13 of the hopper and which is slidably mounted through a pair of eyes 43 and 44 formed by screw eyes driven into the floor 4 of the hopper 2 and through a hole (not separately shown) in the end wall 5 of the hopper 2, and on its outside end the dowel 42 has a decorated head 45. From the releasable cord retainer formed by the dowel 42 and the eye 44, the cord 22 passes diagonally upward to the peg 26 in the top structure 27 formed by the front wall 5 and the end wall 6 of the hopper 2.

Two alternative modes of quickly and conveniently fastening the end of the cord 22 to the cord 22 itself at the peg 26 in the corner top structure at the junction of the front wall 5 and the end wall 6. The first method, which is not illustrated, employs a common tin tie, which is simply a flat strip of plastic with small wire embedded lengthwise through it. The tin tie is placed along side the peg 26, and the end of the cord 22 and the adjacent portion of the cord 22 from the spool 17 are grasped and wrapped about the peg 26 and tin tie three times. Then the tin tie is tightly twisted about the cords 22, securing them together and thus completing the loop of cord. The cord 22 from the spool 17 is then cut at a point 60 to leave about eight inches extending freely from the tin tie for use in tying the bundle as is described below. The second alternative method of fastening the end of the cord 22 to the cord 22 itself employs a furniture clip 46 in the shape of a comb having three extending teeth 58. The teeth 58 of the steel clip 46 have the cord 22 from the spool 17 and from the dowel 42 interlaced through them and the ends of the teeth 58 of the clip 46 are then bent over with a light hammer (not shown) so as to clip the two portions of cord 22 together.

The foregoing being the operative structure of the bailer, additional structures are formed in the preferred embodiment to facilitate its operation and enhance its appearance. As the cord 22 comes through the hole 23 in the floor 4 of the hopper 2 from the spool 17, it passes into a channel 24 which serves as a guide to guide the cord 22 to the top edge 25 of the inside of the front wall 5 of the hopper 2. This channel 24 is formed by a saw kerf with several staples 48 across the top of it to retain the cord 22. Similarly, as the cord 22 passes from the peg 26 in the front top corner structure 27 to the end edge 6 of the floor 2, it passes through a channel 47 created by a saw kerf. In the same manner, a channel 50 is formed in the opposite end 8 by a saw kerf 50, and a third channel 52 is formed by a saw kerf extending from the rear top corner structure 36 to the center of the back floor edge 15. Finally, a fourth channel 54 extends from the center of the front edge 13 of the floor 4 to the front top structure 27. These channels 24, 47, 50, 52 and 54 guide the cord 22 and retain it flush with or beneath the inside surface of the side walls 5, 6, 7 and 8 of the hopper 2 so as not to interfere with the bundle to be stored or tied in the hopper 2. However, the channels 24, 47, 50, 52 and 54 are not essential to the operation of all embodiments of the invention. In addition to the decorated heads 29, 33, 41 and 45 on their respective dowels 28, 32, 38 and 42, identically appearing dummy heads 56 are mounted in the upholstery of the box 1 on opposite corners so as to provide symmetry of design and mask the mundane function of the hassock 1.

To utilize the apparatus described, the cord 22 is drawn from the spool 17 in the manner described and strung within the box with the ends firmly fastened together using either the tin-tie method described above or the alternative E-shaped clip 46. Then the newspapers 57, as they are discarded, may be stacked in the hopper 2 which is dimensioned to fit the standard newspaper. When the stack of newspapers 57 has reached the top of the hopper 2, it is ready to be tied. The tying is accomplished as is shown in FIG. 6, by completing the loop as described above and cutting the cord 22 at a point 60 along the top of the front wall 5 so as to leave a sufficiently long end approximately 8 inches, for tying purposes. Then the cord 22 is lifted over the pegs 26 and 37 in diagonally opposite top corner structures 27 and 36 and the two corners of the loop of cord 22 are pulled together until the above mentioned eight inches of free, cut end of the cord 22 can be passed through the opposite corner of the loop and the two corners of the loop are tied together to create a tight package. While the corners of the loop are initially pulled together, the decorator heads 29, 33, 41 and 45 of the respective dowels 28, 32, 38 and 42 are grasped and the dowels are pulled out releasing the cord 22 to draw up tightly against the stack of papers 57 and freeing the cord 22 and thus the package 57 from the hopper 2.

To achieve a tightly bound bundle, care must be taken in establishing the dimensions of the hopper 2 because these dimensions control the size of the loop of cord 22. In the preferred embodiment shown, which was created for folded newspaper, the front and back panels 5 and 7, respectively, are 16½ inches long and 7 inches deep, and the end panels 6 and 8, respectively, are 13 inches long and 7 inches deep. Thus when newspapers are stacked in the hopper 2 to fill the hopper 2 to the top, a tight bundle can be easily and rapidly and securely bound without tying any knots.

The present invention as disclosed in the above-described embodiment provides a simple, inexpensive and convenient apparatus readily usable in the household for securely and tightly binding bundles of newspapers, or anything else that the householder may wish to bind. It also provides a means for storing newspapers and other items until enough have accumulated to be bundled and disposed of. In addition, it provides a bailing apparatus that can be readily fashioned into an attractive piece of furniture so that it can be used in a living room, or anywhere else, to serve both its bailing and storage function as well as a furniture function and thus occupy a minimum amount of precious space in an apartment or a small dwelling. Those skilled in the art will readily perceive numerous variations and modifications in the preferred embodiment described above to adapt it to different environments and different bundles to be tied. Hence, the foregoing embodiment is not to be deemed to constitute boundaries of the invention, which are rather particularly pointed out and specifically set forth in the claims that follow.

I claim:

1. An apparatus for binding bundles, the combination comprising a hopper for holding a bundle to be bound, having a floor approximately the size of said bundle with two pairs of opposite edges, and having a pair of diagonally opposite corner structures located adjacent diagonally opposite top corners of said bundle;

a supply of cord mounted on said apparatus for binding said bundle;

releasable cord retainers mounted centrally of each of said edges of said floor and on each of said pair of diagonally opposite corner structures to receive and hold said cord drawn from said supply and strung diagonally from each of said corner structures to said releasable cord retainers mounted centrally of said floor edges on opposite sides of said floor and transversely across said floor;

said cord strung about said releasable cord retainers having a free end fastened to itself to form a completed loop of cord with ends of said loop at said diagonally opposite corner structures;

said releasable cord retainers positively retaining said cord loop and said releasable cord retainers mounted centrally of each of said edges of said floor having means external of said hopper for releasing said cord when said bundle is to be tied.

2. An apparatus for binding bundles as set forth in claim 1 wherein said hopper is an enclosed box.

3. An apparatus as set forth in claim 2 wherein said releasable cord retainers mounted approximately in the center of said edges of said floor are manually releasable from outside of said box.

4. An apparatus for binding bundles as set forth in claim 3 wherein said releasable cord retainers in the center edges of said floor comprise dowels projecting through holes in the sides of said hopper and eyes adjacent the edges of said floor, said dowel and one of said eyes forming a retainer and said retainer releases said cord when said dowel is withdrawn.

5. An apparatus for binding bundles as set forth in claim 4 wherein said hopper has a hinged top;

and said supply of cord is a spool of cord rotatably mounted beneath said floor of said hopper to feed said cord through a hole in said floor.

6. An apparatus for binding bundles as set forth in claim 5 wherein said bundle is a stack of wastepapers accumulated in said hopper and tied for disposal.

* * * * *